US008047015B2

(12) United States Patent
An et al.

(10) Patent No.: US 8,047,015 B2
(45) Date of Patent: Nov. 1, 2011

(54) ICE MAKER FOR REFRIGERATOR

(75) Inventors: Si-Yeon An, Gimhae (KR); Seong-Wook Kim, Changwon (KR); Joo-Won Park, Busan (KR)

(73) Assignee: LG Electronics Inc., Seoul (KR)

( * ) Notice: Subject to any disclaimer, the term of this patent is extended or adjusted under 35 U.S.C. 154(b) by 500 days.

(21) Appl. No.: 12/377,849

(22) PCT Filed: Dec. 18, 2006

(86) PCT No.: PCT/KR2006/005539
§ 371 (c)(1),
(2), (4) Date: Feb. 17, 2009

(87) PCT Pub. No.: WO2008/075801
PCT Pub. Date: Jun. 26, 2008

(65) Prior Publication Data

US 2010/0192615 A1 Aug. 5, 2010

(51) Int. Cl.
*F25C 1/22* (2006.01)
*F25C 5/18* (2006.01)

(52) U.S. Cl. ..... 62/340; 62/344

(58) Field of Classification Search ..... 62/237, 62/330, 340, 344, 347
See application file for complete search history.

(56) References Cited

U.S. PATENT DOCUMENTS

| | | | |
|---|---|---|---|
| 4,649,718 | A | 3/1987 | Linstromberg et al. |
| 6,041,607 | A | 3/2000 | Kim |
| 6,148,624 | A | 11/2000 | Bishop et al. |

FOREIGN PATENT DOCUMENTS

| | | | |
|---|---|---|---|
| CN | 2636161 | Y | 8/2004 |
| GB | 2 282 216 | A | 3/1995 |
| GB | 2 299 657 | A | 10/1996 |
| KR | 10-2004-0102568 | A | 12/2004 |
| KR | 10-2006-0004542 | A | 1/2006 |

*Primary Examiner* — Chen Wen Jiang
(74) *Attorney, Agent, or Firm* — Birch, Stewart, Kolasch & Birch, LLP

(57) ABSTRACT

The present invention relates to an ice maker for a refrigerator. The present invention provides an ice maker for a refrigerator, which is provided at one side of the refrigerator to make ice. The ice maker comprises an ice maker body provided with an ice-making tray for making ice; an ejector rotatably mounted at one side of the ice maker body so as to eject ice made in the ice-making tray to the outside; a water supply hopper provided at one side of the ice maker body and having at least an open portion so that the water supply hopper is supplied with water from a water supply source through a water supply tube and then transfers the water to the ice-making tray; and a hopper cover coupled to the water supply hopper so as to selectively open and close the open portion of the water supply hopper. According to the present invention, it is possible to avoid a phenomenon in which water supplied from an outer water supply source to the water supply hopper splashes to the outside.

7 Claims, 4 Drawing Sheets

【Figure 1】
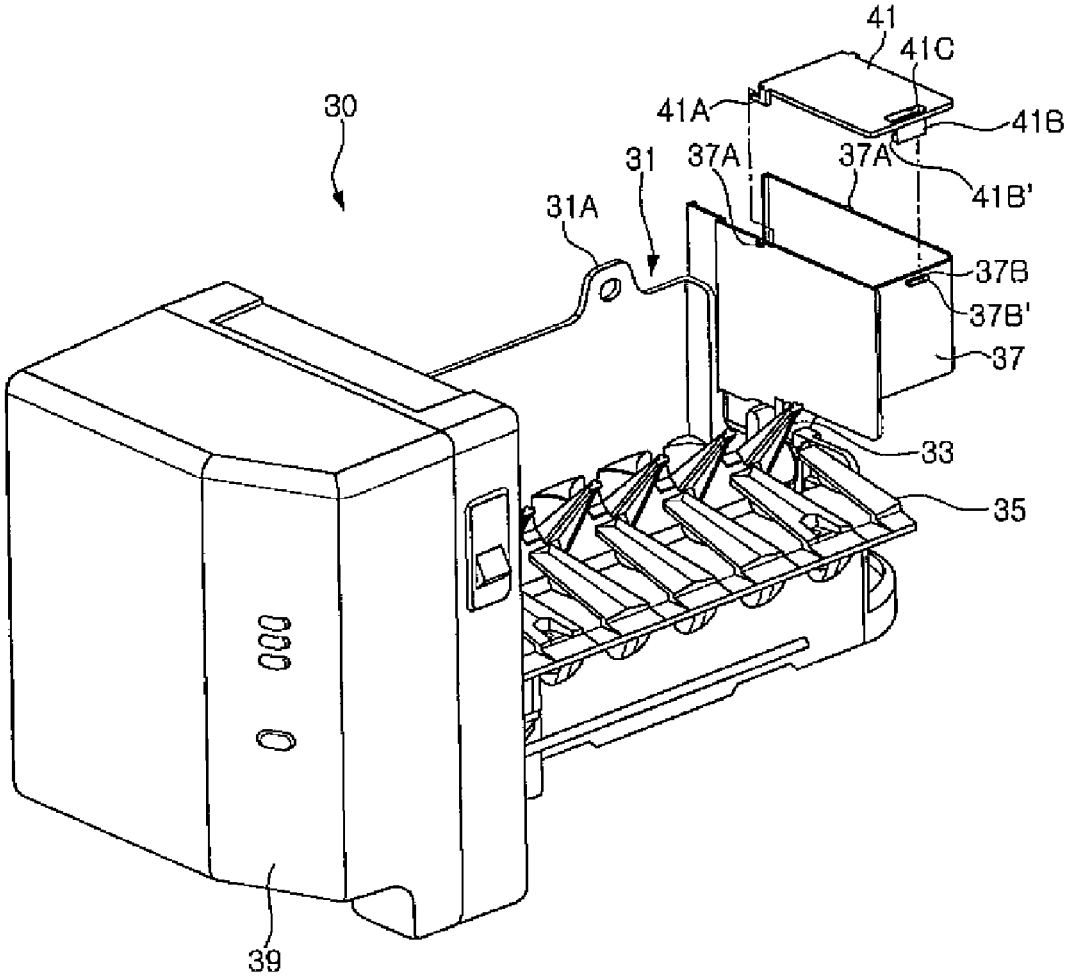

【Figure 2】
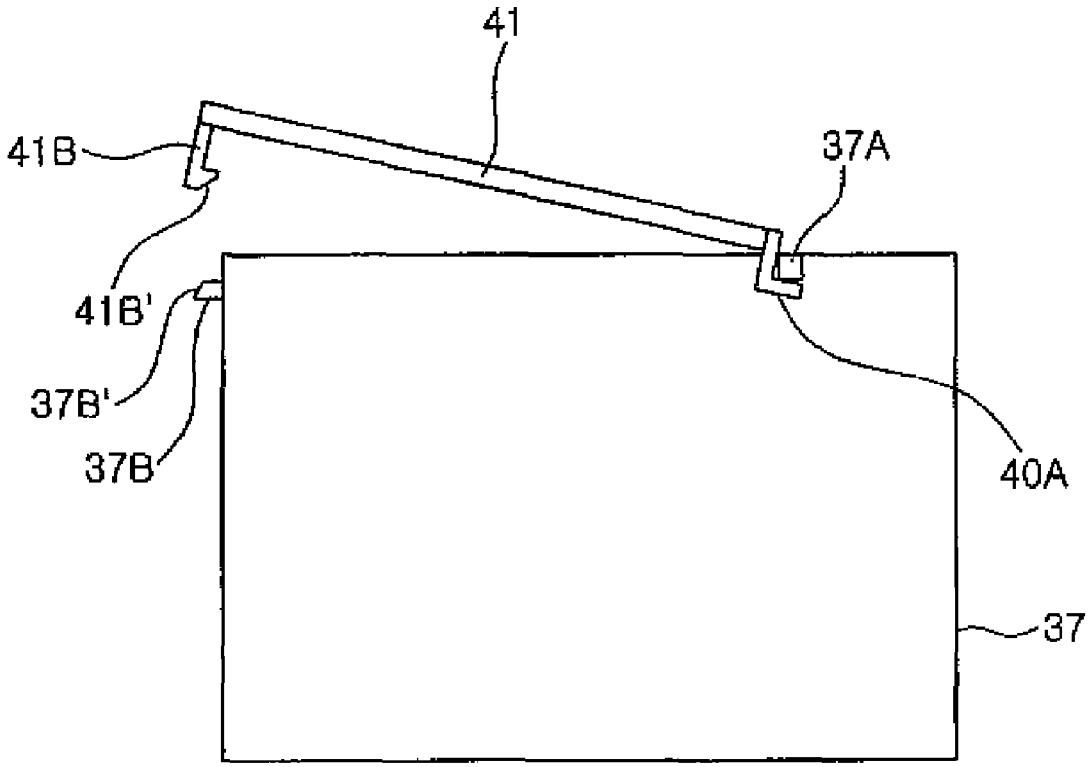

[FIG. 3]
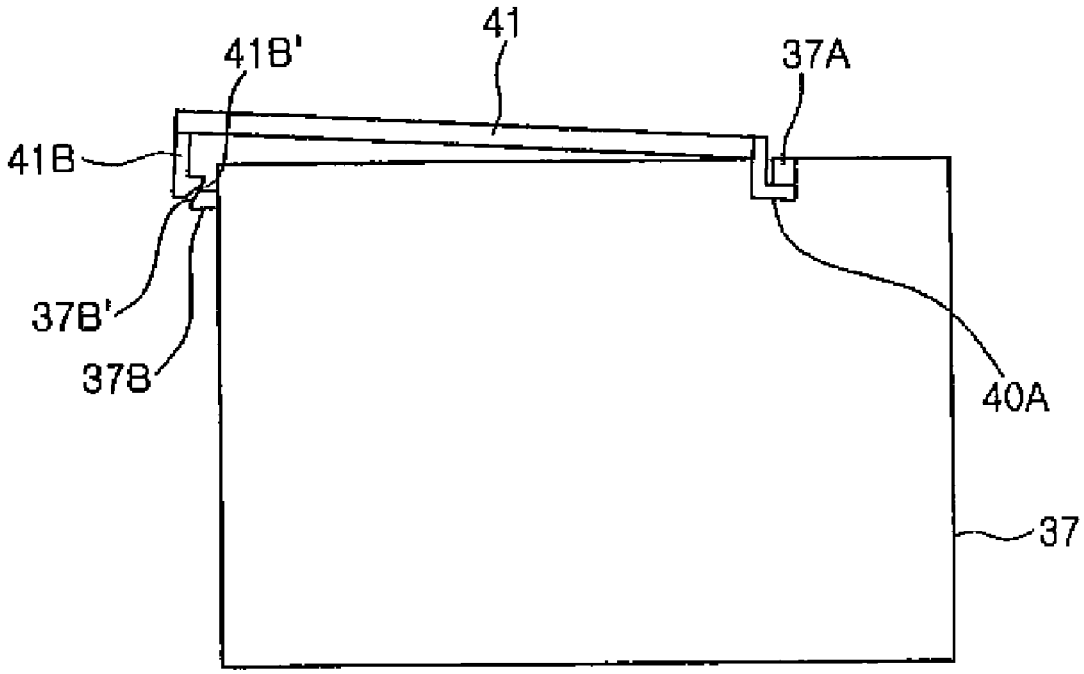

【Figure 4】
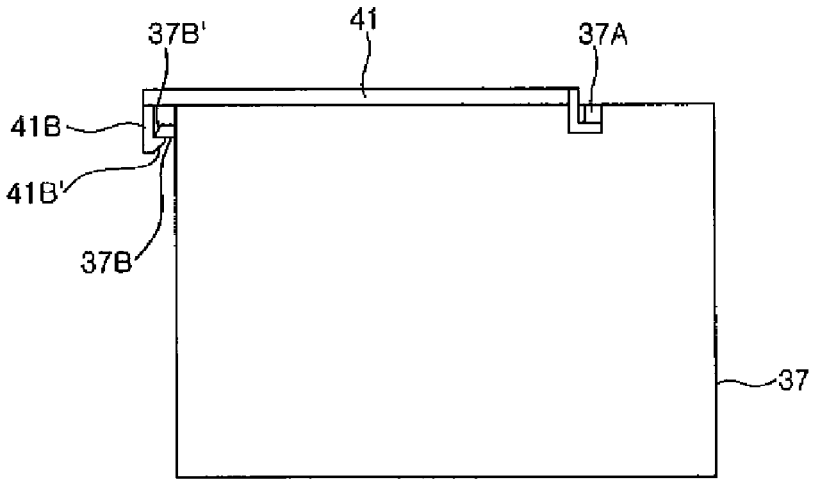
【Figure 5】
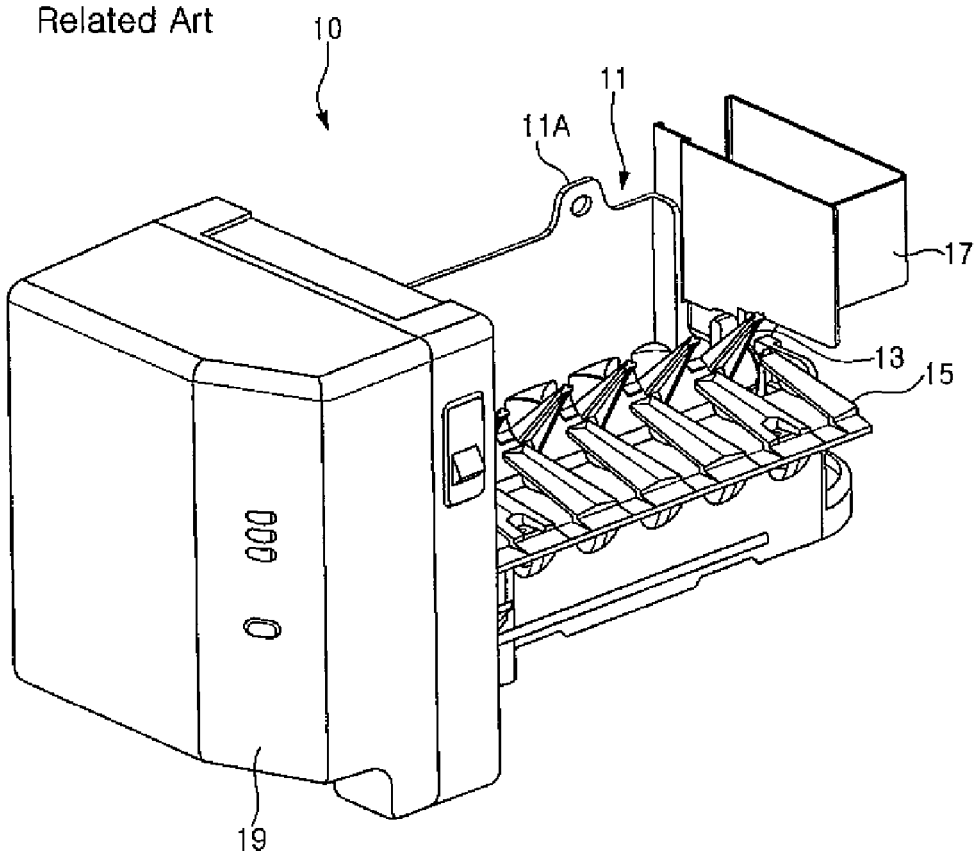

ICE MAKER FOR REFRIGERATOR

TECHNICAL FIELD

The present invention relates to a refrigerator, and more particularly, to an ice maker for a refrigerator, which is provided in a refrigerator to make ice

BACKGROUND ART

Recently, a refrigerator with an ice maker, which makes ice and supplies the ice to a user, is commercially available. FIG. 5 shows a conventional ice maker for a refrigerator.

As shown in this figure, an ice maker body 11 of an ice maker 10 is provided with an ice-making tray. The ice-making tray is to substantially make ice by receiving water from a water supply hopper 17 which will be explained below. Furthermore, one side of the ice maker body 11 is provided with at least a pair of mounting flanges 11A for mounting the ice maker 10 on a refrigerator.

Meanwhile, one side of the ice maker body 11 that is above the ice-making tray is provided with an ejector 13. The ejector 13 is to eject ice made in the ice-making tray to the outside, and is rotatably mounted on the ice maker body 11.

The other side of the ice maker body 11 that corresponds to a side opposite to the ejector 13 is provided with a stripper 15. The stripper 15 functions to prevent ice from entering back the ice-making tray while the ejector 13 ejects the ice made in the ice-making tray to the outside.

The ice maker body 11 is provided with the water supply hopper 17. The water supply hopper 17 is to transfer water supplied from an outer water supply source to the ice-making tray, and is positioned relatively above the ice-making tray. The water supply hopper 17 is formed in the form of a hexahedron with an open top face and an open side face, and one end of a water supply tube (not shown) connected to the water supply source is secured to the open side face of the water supply hopper 17.

Furthermore, the ice maker body 11 is provided with a housing 19. Various parts such as a driving motor (not shown) for driving the ice-making tray, the ejector 13 and the like are installed within the housing 19.

However, such a conventional ice maker for a refrigerator has the following problems.

As described above, water that is supplied to the water supply hopper 17 through the water supply tube is transferred to the ice-making tray to make ice. At this time, in order to prevent water flowing through the inside of the water supply tube from being frozen, water that is supplied through the water supply tube is under relatively high water pressure. Therefore, there is a risk that water supplied to the water supply hopper 17 through the water supply tube may splash to the outside of the water supply hopper 17 due to the high water pressure.

DISCLOSURE

Technical Problem

The present invention is conceived to solve the aforementioned problems in the prior art. An object of the present invention is to provide an ice maker for a refrigerator, which is constructed to prevent water supplied for making ice from splashing to the outside.

Technical Solution

According to an aspect of the present invention for achieving the object, there is provided an ice maker for a refrigerator, the ice maker being provided at one side of the refrigerator to make ice, the ice maker comprising: an ice maker body provided with an ice-making tray for making ice; an ejector rotatably mounted at one side of the ice maker body so as to eject ice made in the ice-making tray to the outside; a water supply hopper provided at one side of the ice maker body and having at least an open portion so that the water supply hopper is supplied with water from a water supply source through a water supply tube and then transfers the water to the ice-making tray; and a hopper cover coupled to the water supply hopper so as to selectively open and close the open portion of the water supply hopper.

In one embodiment of the invention, the water supply hopper is formed in the form of a hexahedron with an open top face and an open side face, and the hopper cover selectively opens and closes the open top face of the water supply hopper.

In another embodiment of the invention, a pair of outwardly protruding locking protrusions and an outwardly protruding latching protrusion are provided on both opposite side surfaces of the water supply hopper and one surface thereof between the both side surfaces, respectively;

Preferably, a bottom surface of the hopper cover is provided with a pair of locking ribs to be caught by the locking protrusions and one latching hook to which the latching protrusion is elastically latched; and the hopper cover is coupled to the water supply hopper by latching the latching hook to the latching protrusion in a state where the locking ribs have been caught by the locking protrusions.

More preferably, a tip of the latching protrusion is provided with a guide surface, and a tip of the latching hook is provided with a latching ledge that is guided by the guide surface and then brought into close contact with one side of a bottom surface of the latching protrusion. In another embodiment of the invention, an elastic opening for giving an elastic force to the latching hook is formed at one side of the hopper cover that is adjacent to the latching hook.

Preferably, the open side face of the water supply hopper is covered by one surface defining a storage space of the refrigerator.

More preferably, the open side face of the water supply hopper is covered by a back surface of a refrigerator door for selectively opening and closing a storage space of the refrigerator.

Advantageous Effects

According to the present invention thus constructed, there is an advantage in that water supplied for making ice is prevented from splashing to the outside of the water supply hopper.

DESCRIPTION OF DRAWINGS

FIG. 1 is an exploded perspective view showing a state where a water supply hopper and a hopper cover of an ice maker for a refrigerator according to a preferred embodiment of the present invention are separated from each other;

FIGS. 2 to 4 are views showing the process of coupling the hopper cover to the water supply hopper in the embodiment shown in FIG. 1; and FIG. 5 is a perspective view showing a conventional ice maker for a refrigerator.

BEST MODE

Hereinafter, an ice maker for a refrigerator according to a preferred embodiment of the present invention will be described in detail with reference to the accompanying drawings.

FIG. 1 shows an ice maker for a refrigerator according to a preferred embodiment of the present invention.

As shown in the figure, an ice maker body 31 of an ice maker 30 is provided with an ice-making tray for making ice. Furthermore, one side of the ice maker body 31 is provided with a pair of mounting flanges 31A for mounting the ice maker 30 on one side of a refrigerator, for example, on one side of a storage space of the refrigerator or on a back surface of a refrigerator door for selectively opening and closing the storage space of the refrigerator.

Moreover, one side of the ice maker body 31 is provided with an ejector 33. The ejector 33 is to eject ice made in the ice-making tray to the outside, and is rotatably installed on one side of the ice maker body 31 that is above the ice-making tray.

In addition, the ice maker body 31 is provided with a stripper 35. The stripper 35 functions to prevent ice from entering back the inside of the ice-making tray while the ejector 33 ejects the ice made in the ice-making tray to the outside, and is provided at the other side of the ice maker body 31 that corresponds to a side opposite to the ejector 33.

Meanwhile, the ice maker body 31 is provided with a water supply hopper 37 for transferring water to the ice-making tray. The water supply hopper 37 is to transfer water supplied from an outer water supply source through a water supply tube (not shown), and is provided at one side of the ice maker body 31 that is above the ice-making tray.

The water supply hopper 37 is formed in the form of a hexahedron with an open top face and an open side face. At this time, the open side face can be substantially covered by being brought into close contact with one surface defining the storage space or the back surface of the refrigerator door. Furthermore, in the water supply hopper 37, upper ends of both opposite side surfaces and an upper end of one surface between the both side surfaces are provided respectively with a pair of locking protrusions 37A and one latching protrusion 37B for coupling a hopper cover 41, which will be explained below, to the water supply hopper 37.

The locking protrusions 37A and the latching protrusion 37B protrude outwardly by respective predetermined distances from the surfaces of the water supply hopper 37. Furthermore, locking ribs 41A that will be explained below are caught by the locking protrusions 37A, and the latching protrusion 37B is elastically latched to a latching hook 41B which will be explained below.

The locking protrusions 37A are positioned approximately at the centers of the upper ends of the both opposite side surfaces of the water supply hopper 37. The latching protrusion 37B is positioned at the center of the upper end of the one surface of the water supply hopper 37. Furthermore, the latching protrusion 37B has a tip provided with a guide surface 37B' for guiding a latching ledge 41B' of the latching hook 41B. The guide surface 37B' is formed by causing the tip of the latching protrusion 37B to be inclined downwardly.

Meanwhile, water is supplied from a water supply source, which is inside or outside of the refrigerator, into the water supply hopper 37 through the water supply tube. Furthermore, the hopper cover 41 is provided for selectively opening and closing the open top face of the water supply hopper 37.

The hopper cover 41 that is to selectively open and close the open top face of the water supply hopper 37 is formed in a rectangular shape corresponding to the open top face of the water supply hopper 37. Although the hopper cover 41 partially covers the open top face of the water supply hopper 37 in the illustrated embodiment, the hopper cover 41 may be constructed to fully cover the open top face of the water supply hopper 37.

Ends of both sides of the hopper cover 41 are provided with the locking ribs 41A. The locking ribs 41A extend downwardly from a bottom surface of the hopper cover 41. Furthermore, the locking ribs 41A are formed in an "L" shape to be caught by the locking protrusions 37A.

Moreover, the latching hook 41B is provided at a farthest position from the ends of the both sides of the hopper cover 41 where the locking ribs 41A are provided, i.e., at the center of one end of the hopper cover 41 that corresponds to a side opposite to the locking ribs 41A. The latching hook 41B has certain elasticity and extends downwardly from the bottom surface of the hopper cover 41, so that the latching hook can be elastically latched to the latching protrusion 37B.

Furthermore, the latching ledge 41B' is provided at the tip of the latching hook 41B. The latching ledge 41B' is guided by the guide surface 37B' while the latching hook 41B is latched to the latching protrusion 37B. The latching ledge 41B' comes into close contact with a bottom surface of the latching protrusion 37B when the latching hook 41B is latched to the latching protrusion 37B, thereby functioning to substantially fasten the latching hook 41B to the latching protrusion 37B.

Meanwhile, an elastic opening 41C is formed at one side of the hopper cover 41 that is adjacent to the latching hook 41B. The elastic opening 41C gives a certain elastic force to the latching hook 41B so that the latching hook 41B can be elastically deformed when it is fastened to the latching protrusion 37B.

Reference numeral 39 that has not yet been explained designates a housing. Various parts such as a driving motor (not shown) for driving the ejector 33 and the like are installed within the housing 39.

Hereinafter, a process of coupling the hopper cover to the water supply hopper in the ice maker for a refrigerator according to the preferred embodiment of the present invention will be described in greater detail with reference to the accompanying drawings.

FIGS. 2 to 4 show the process of coupling the hopper cover to the water supply hopper in the ice maker for a refrigerator according to the preferred embodiment of the present invention.

First, as shown in FIG. 2, the hopper cover 41 is moved so that the locking ribs 41A of the hopper cover 41 can be caught by the locking protrusions 37A of the water supply hopper 37. That is, the hopper cover 41 is moved toward the open top face of the water supply hopper 37 such that the one end of the hopper cover 41 which is provided with the locking ribs 41A is inclined downwardly.

When the locking ribs 41A are caught by the locking protrusions 37A, the other end of the hopper cover 41 is pivoted on the one end of the hopper cover 41 which is provided with the locking ribs 41A. Hence, as the hopper cover 41 is pivoted in a counterclockwise direction in the figure, the open top face of the water supply hopper 37 is gradually covered by the hopper cover, as shown in FIG. 3.

Meanwhile, as the hopper cover 41 is continuously pivoted in the counterclockwise direction in the figure, an edge of the bottom surface of the hopper cover 41 is brought into close contact with an edge of the top face of the water supply hopper 37, as shown in FIG. 4. Simultaneously, the latching hook 41B of the hopper cover 41 is elastically latched to the latching protrusion 37B of the water supply hopper 37. At this time, the latching ledge 41B' of the latching hook 41B is guided by the guide surface 37B' of the latching protrusion 37B and then brought into close contact with the bottom surface of the latching protrusion 37B.

Next, a process of making ice by the ice maker for a refrigerator according to the preferred embodiment of the present invention will be described.

First, water is supplied from an outer water supply source to the water supply hopper 37 through the water supply tube. The supplied water is transferred from the water supply hopper 37 to the ice-making tray. At this time, since the open top face of the water supply hopper 37 is covered by the hopper cover 41, the water supplied through the water supply tube under relatively high water pressure is prevented from splashing to the outside of the water supply hopper 37.

Meanwhile, the water supplied to the ice-making tray is frozen by cold air supplied to the ice-making tray so that ice is made. When ice is completely made, the ice is separated from the ice-making tray due to heat generated by a heater (not shown) provided at a lower portion of the ice-making tray.

Then, the ice placed within the ice-making tray is ejected to the outside by means of rotation of the ejector 33. At this time, the ejected ice is prevented from entering back the ice-making tray by the stripper 35, and the ice ejected from the ice-making tray is stored in an ice storage container (not shown) positioned below the ice-making tray.

It will be apparent that those skilled in the art can make various modifications and changes within the fundamental technical spirit of the present invention. The true scope of the present invention should be construed on the basis of the appended claims.

INDUSTRIAL APPLICABILITY

With the ice maker for a refrigerator according to the present invention thus constructed, the following advantages can be expected.

Water supplied from the water supply source for making ice is prevented from splashing to the outside of the water supply hopper. Hence, it is possible to avoid a phenomenon in which ice or frost is formed inside of a refrigerator due to water splashing to the outside of the water supply hopper, and thus, the refrigerator can be used more hygienically.

In particular, in a case where an ice maker is mounted on a refrigerator door, the width of a water supply hopper is decreased. Thus, there may be a high possibility that water supplied from the water supply source will splash to the outside of the water supply hopper. However, according to the present invention, since the open portion of the water supply hopper is covered by the hopper cover, it is possible to prevent water supplied from the water supply source from splashing to the outside of the water supply hopper.

The invention claimed is:

1. An ice maker for a refrigerator, the ice maker being provided at one side of the refrigerator to make ice, the ice maker comprising:

an ice maker body provided with an ice-making tray for making ice;

an ejector rotatably mounted at one side of the ice maker body so as to eject ice made in the ice-making tray to the outside;

a water supply hopper provided at one side of the ice maker body and having at least an open portion so that the water supply hopper is supplied with water from a water supply source through a water supply tube and then transfers the water to the ice-making tray; and a hopper cover coupled to the water supply hopper so as to selectively open and close the open portion of the water supply hopper.

2. The ice maker as claimed in claim 1, wherein the water supply hopper is formed in the form of a hexahedron with an open top face and an open side face, and the hopper cover selectively opens and closes the open top face of the water supply hopper.

3. The ice maker as claimed in claim 2, wherein a pair of outwardly protruding locking protrusions and an outwardly protruding latching protrusion are provided on both opposite side surfaces of the water supply hopper and one surface thereof between the both side surfaces, respectively;

a bottom surface of the hopper cover is provided with a pair of locking ribs to be caught by the locking protrusions and one latching hook to which the latching protrusion is elastically latched; and the hopper cover is coupled to the water supply hopper by latching the latching hook to the latching protrusion in a state where the locking ribs have been caught by the locking protrusions.

4. The ice maker as claimed in claim 3, wherein a tip of the latching protrusion is provided with a guide surface, and a tip of the latching hook is provided with a latching ledge that is guided by the guide surface and then brought into close contact with one side of a bottom surface of the latching protrusion.

5. The ice maker as claimed in claim 3 or 4, wherein an elastic opening for giving an elastic force to the latching hook is formed at one side of the hopper cover that is adjacent to the latching hook.

6. The ice maker as claimed in claim 5, wherein the open side face of the water supply hopper is covered by one surface defining a storage space of the refrigerator.

7. The ice maker as claimed in claim 5, wherein the open side face of the water supply hopper is covered by a back surface of a refrigerator door for selectively opening and closing a storage space of the refrigerator.

* * * * *